US007775623B2

(12) United States Patent
Hasegawa

(10) Patent No.: US 7,775,623 B2
(45) Date of Patent: Aug. 17, 2010

(54) IMAGE FORMING APPARATUS

(75) Inventor: Shin Hasegawa, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 295 days.

(21) Appl. No.: 12/008,462

(22) Filed: Jan. 10, 2008

(65) Prior Publication Data

US 2008/0186336 A1 Aug. 7, 2008

(30) Foreign Application Priority Data

Jan. 10, 2007 (JP) ..... 2007-002013

(51) Int. Cl.
*B41J 2/165* (2006.01)

(52) U.S. Cl. ..... 347/27

(58) Field of Classification Search ..... 347/22, 347/27

See application file for complete search history.

(56) References Cited

U.S. PATENT DOCUMENTS 5,574,485 A * 11/1996 Anderson et al. ..... 347/27

FOREIGN PATENT DOCUMENTS

| | | |
|---|---|---|
| EP | 07329310 | 12/1995 |
| EP | 0 911 171 | 4/1999 |
| EP | 0 976 563 | 2/2000 |
| EP | 0 997 290 | 5/2000 |
| EP | 2006347000 | 12/2006 |
| JP | 6340091 | 12/1994 |
| JP | 9029996 | 2/1997 |
| JP | 2001315354 | 11/2001 |
| JP | 2004330682 | 11/2004 |

* cited by examiner

*Primary Examiner*—Huan H Tran
(74) *Attorney, Agent, or Firm*—Frommer Lawrence & Haug LLP

(57) ABSTRACT

An image forming apparatus includes: a recording head including a plurality of nozzles which eject ink drops onto a recording medium to form an image; and a vibrator which is disposed to face the plurality of nozzles and vibrates in a non-printing state.

15 Claims, 2 Drawing Sheets

IMAGE FORMING APPARATUS

CROSS-REFERENCE TO RELATED APPLICATION

This application claims priority from Japanese Patent Application No. 2007-002013, filed on Jan. 10, 2007, the entire subject matter of which is incorporated herein by reference.

TECHNICAL FIELD

Aspects of the present invention relates to an image forming apparatus which forms an image by ejecting ink drops onto a recording medium and, more particularly, to a configuration for preventing ink in nozzles from increasing in viscosity or drying.

BACKGROUND

JP-A-9-29996 discloses an image forming apparatus which forms an image by ejecting ink drops. In order to prevent ink in nozzles from increasing in viscosity or drying, the image forming apparatus performs a flushing operation in which ink are ejected regardless of image formation or a micro-vibrating operation in which micro-vibrations are given to inks in nozzles by driving an ejection actuator in such a degree that inks are not ejected from the nozzles.

However, the flushing operation consumes inks wastefully and consumes time since it is necessary for a recording head to move to a position which receives inks ejected in the flushing operation. On the other hand, the micro-vibrating operation does not consume inks wastefully. However, in the micro-vibrating operation, the ejection actuator and a drive circuit thereof are heated since it is necessary to drive the ejection actuator by a number of times in order to give a number of times of vibrations to ink in order to obtain an effect of preventing ink from increasing in viscosity or drying. Therefore, not only the durability of the ejection actuator and drive circuit may become worse but also the ejection performance may become worse due to the heat.

SUMMARY

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide an image forming apparatus that does not consume inks wastefully and reduce worsening in the durability and the ejection performance of the ejection actuator and drive circuit thereof.

The above and other aspects of the present invention are accomplished by providing an image forming apparatus including: a recording head including a plurality of nozzles which eject ink drops onto a recording medium to form an image; and a vibrator which is disposed to face the plurality of nozzles and vibrates in a non-printing state.

DETAILED DESCRIPTION

Exemplary Embodiment

Figure 1:
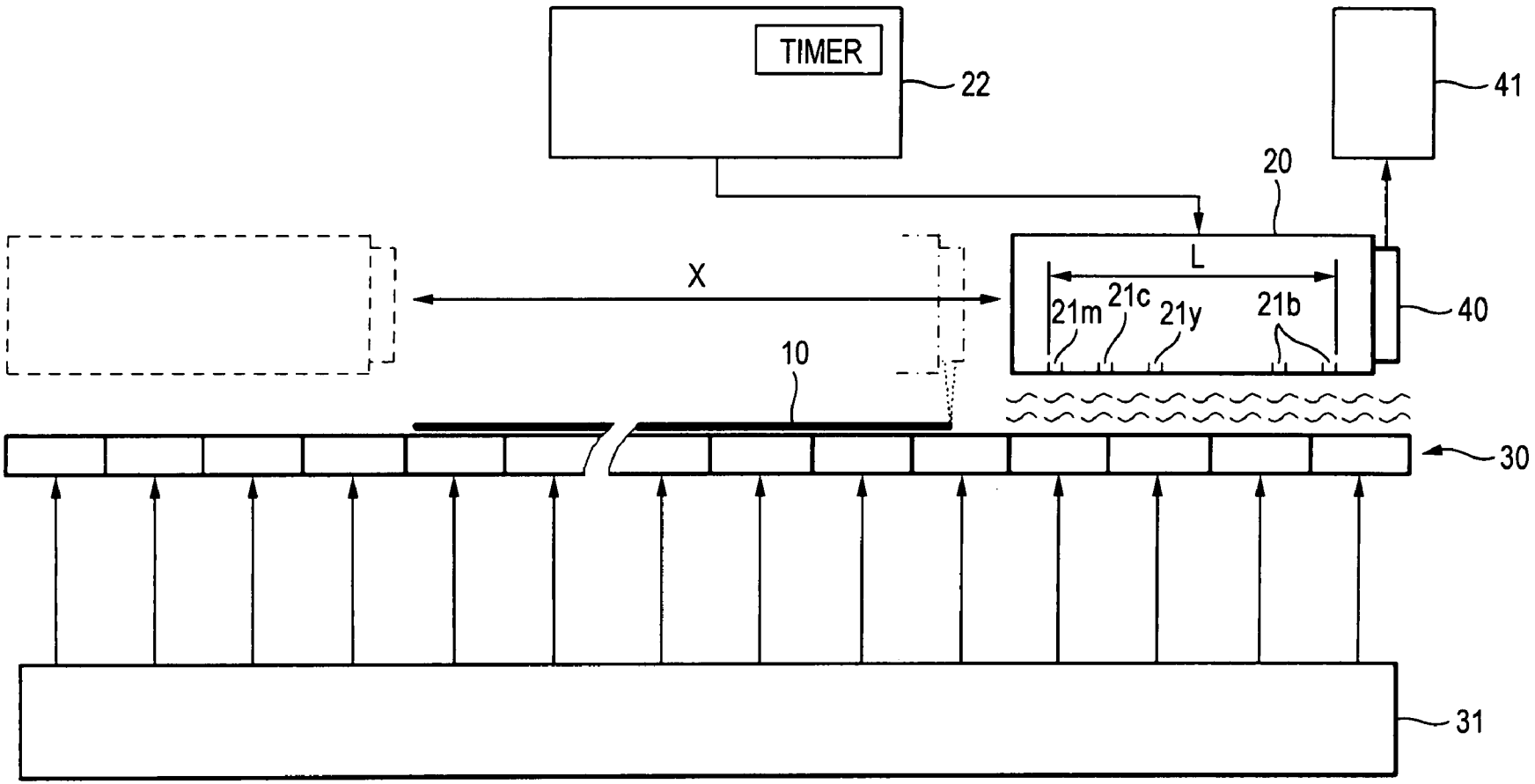
FIG. 1 is a schematic front elevational view of an image forming apparatus according to an exemplary embodiment of the present invention.

FIG. 1 is a schematic front elevational view of an image forming apparatus according to an exemplary embodiment of the present invention. As shown in FIG. 1, an image forming apparatus according to an exemplary embodiment includes a recording head 20 and a plurality of vibrators 30 above which a recording medium 10 such as a recording sheet, etc., is conveyed in a conveying direction orthogonal to the sheet of the drawing by a known sheet conveying unit. The recording head 20 is moved to reciprocate by a known drive unit in a moving direction X (the left and right direction on the sheet of the drawing) orthogonal to the conveying direction in parallel to the upper surface of the recording medium 10.

Figure 2:
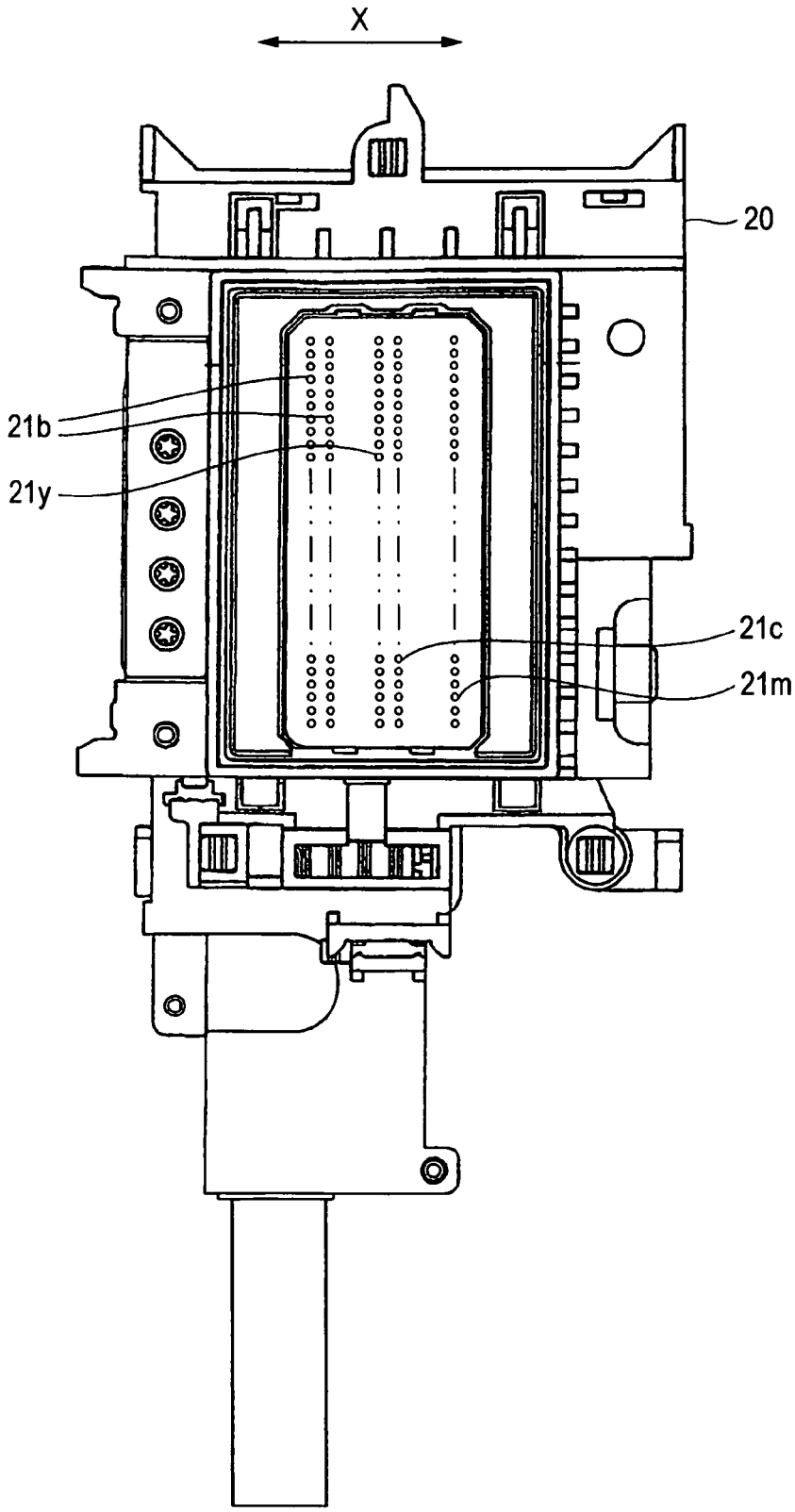
FIG. 2 is a plan view of a recording head of the image forming apparatus when viewed from a nozzle surface.

The recording head 20 is a known ink jet type head. The recording head 20 forms an image in a dot matrix form by ejecting ink drops from the nozzles 21 to the recording medium. FIG. 2 is a plan view of the recording head 20 when viewed from a bottom surface (nozzle surface) facing a recording medium 10. The recording head 20 includes a plurality of nozzles 21 having openings on the nozzle surface. Specifically, the plurality of nozzles 21 includes nozzles 21*b* which ejects black ink, nozzles 21*y* which ejects yellow ink, nozzles 21*c* which ejects cyan ink, and nozzles 21*m* which ejects magenta ink. Each of the nozzles 21*b*, 21*y*, 21*c* and 21*m* are arranged in a line extending in a direction orthogonal to the moving direction X of the recording head 20. Note that the nozzles 21 may include only nozzles for ejecting black ink for a monochrome image forming apparatus.

The plurality of vibrators 30 are arrayed in the moving direction X of the recording head 20 under the recording medium 10 and in parallel with a moving path of the recording head 20. The array length of the vibrators 30 corresponds to a length obtained by adding a length of the recording head 20 in the moving direction to the width of the maximum recording medium 10 usable in the image forming apparatus 1 (for example, the width of A4 size) at both sides of the maximum recording medium 10. Therefore, when the recording head 20 moves to both outsides of the recording medium 10, the plurality of nozzles 21 of the recording head 20 face the vibrator 30 in parallel therewith at any position. When the recording medium 10 is conveyed, upper surfaces of a part of vibrators 30 located in overlapping area of a conveying path within which the recording medium 10 is conveyed, can serve as a guiding surface, that is, a platen surface of the recording medium 10. On the other hand, the vibrators 30 are disposed in a range corresponding to a length of the nozzles 21 in the direction orthogonal to the moving direction X of the recording head 20.

Each of the vibrators 30 includes an electrostriction element, etc. The vibrators 30 are selectively driven by a drive circuit 31 and vibrate to generate acoustic vibrations for inks in the nozzles 21 opposed thereto. The acoustic vibrations vibrate inks in the nozzles 21 via air between the vibrators 30 and the nozzles 21 and agitate inks in the nozzles 21. Therefore, inks exposed to atmosphere from the nozzles 21 are prevented from increasing in viscosity and drying. It maybe advantageous that the acoustic vibrations have frequency from 20 kHz to 40 kHz which exceeds an audible range of people so that the acoustic vibrations are not harsh to users. However, such a frequency which plays a melody even in the audible range may be used. The output of the acoustic vibrations may be determined based on a diameter of the opening of the nozzles 21, and physical properties of ink such as viscosity and a surface tension and may be appropriately changed according to an environmental temperature. The distance between the vibrators 30 and the nozzles 21 is approximately 2 mm or less.

The controller 22 controls reciprocation of the recording head 20. The recording head 20 includes a sensor 40 facing the recording medium 10. As publicly known, the sensor emits light and receives reflection light. A detector 41 coupled to the sensor 40 detects the width of the recording medium 10 in cooperation with reciprocation of the recording head 20.

The controller 22 controls the range of reciprocation of the recording head 20 based on the length of an image to be formed on the recording medium 10 in the width direction of the recording medium 10 (in the moving direction X). In addition, in the operation for preventing inks from increasing in viscosity and drying, the controller 22 sets the moving range of the recording head 20 to a range obtained by adding at least a length L of a range of the plurality of nozzles 21 in the moving direction of the recording head 20 to the width of the recording medium 10, which is detected by the detector 41.

Based on the width of the recording medium 10, which is detected by the detector 41, the drive circuit 31 sets a part of the vibrators 30 at a position, which is proximal to the recording medium and outside the recording medium 10, to be operable. At this time, the number of the vibrators 30 that become operable is the number corresponding to the length L of the range of the plurality of nozzles 21 in the moving direction of the recording head 20.

When forming an image, the recording head 20 moves to reciprocate in the width of the recording medium 10 and forms an image. The controller 22 moves the recording head 20 to a position, in which the plurality of nozzles 21 face a part of the vibrators 30 and outside the recording medium 10, once several times of the reciprocation in order to prevent ink from increasing in viscosity and drying. If the drive circuit 31 receives from the controller 22 a signal indicating that the recording head 20 has moved to the position outside the recording medium 10, the drive circuit 31 drives the part of the vibrators 30 facing the nozzles 21 located outside the recording medium 10. Then, acoustic vibrations generated from the vibrators 30 vibrate and agitate inks in the nozzles 22, and prevent inks, which are exposed to atmosphere from the nozzles 22, from increasing in viscosity and drying. On the other hand, in the direction orthogonal to the moving direction X of the recording medium, the vibrators 30 are driven evenly so that inks in nozzles for each line (color) are vibrated evenly by the vibrators 30.

According to the configuration described above, the operation for preventing inks from increasing in viscosity and drying may be performed at a nearer side in the moving direction of the recording head 20 at either the left or right side outside the recording medium 10. Since vibrators 30 proximal to the outside of the recording medium 10 will be used if the width of the recording medium 10 becomes smaller, the moving range of the recording head 20 becomes smaller. Therefore, the time required to form an image can be shortened.

Other Embodiment

The present invention is not limited to the embodiment that has been described above with reference to the drawings. For example, the following embodiments may also fall within the technical scope of the present invention.

Although the number of the vibrators 30 corresponding to the length L of the entire range of the nozzles 21 are driven in the above exemplary embodiment, the present invention is not limited thereto. Only the number of the vibrators 30 corresponding to a shorter range than the length L of the range of the nozzles 21 may be driven while moving the recording head 20 so that the respective nozzles 21 face the vibrators 30 in order. In addition, the vibrators 30 may be disposed in a longer range than the length L of the range of the nozzles 21 at both sides of the recording medium 10. In this case, the recording medium can be moved while all the nozzles 21 face the vibrators 30. That is, the array length of the vibrators 30 in the moving direction of the recording head 20 may be set into a length obtained by adding 0.3 to 2 times of the length L of the range of the nozzles 21 to both sides of the maximum width of a usable recording medium.

The operation by the vibrators 30 for all nozzles may not be performed at one time. For example, a part of the vibrators 30 corresponding to nozzles for two colors may be driven when the recording head 20 moves to one outside of the recording medium 10. And a part of the vibrators 30 corresponding to the other two colors may be driven when the recording head 20 moves to the other outside of the recording medium 10. Specifically, when the recording head 20 moves to the right of the recording medium 10 in FIG. 1, a part of the vibrators 30 corresponding to the nozzles 21*b* and 21*y* are driven. When the recording head 20 moves to the left of the recording medium 10, a part of the vibrators 30 corresponding to the nozzles 21*c* and 21*m* are driven.

Although the width of the recording medium 10 is determined with the sensor 40, the present invention is not limited thereto. The width of the recording medium 10 may be determined without the sensor. In this case, the width of the recording medium 10 may be determined by driving all the vibrators 30 temporally while the recording medium 10 is positioned on the vibrators 30. Then, the area where the recording medium 10 exists can be obtained by detecting counterelectromotive force generated when the vibrators 30 are driven.

Although the width of the recording medium 10 is detected, the present invention is not limited thereto. The width of the recording medium 10 may not be set by a generation unit of image data or set by movement of a known guiding member which guides both sides of the recording medium in the width direction thereof.

A restoring unit which restores function of the recording head 20 by suctioning inks from nozzles 21 is disposed outside the array of the vibrators 30 in a direction extending from the vibrators 30. Generally, when restoring unit restores function of the recording head 20, the recording head 20 has to move to the restoring unit. Additionally, the operation for restoring function of the recording head 20 may include suctioning inks from nozzles 21 and wiping the nozzles 21. Therefore, the operation of restoring unit takes more time than the operation by the vibrators 30 and meniscus of inks in nozzles can be unstable.

The operation for preventing inks in nozzles from increasing in viscosity or drying by the vibrators 30 may be performed once in a predetermined time period when the image forming apparatus is in a standby state (non-printing state). For example, the operation is performed once in five minutes for ten seconds. Then, if the standby state continues more long time, the operation by the restoring unit may be performed. That is, the operation of the restoring unit is performed once in a predetermined time period longer than the predetermined time period regarding the vibrators 30. In this case, the controller 22 includes a timer which times the standby state and a time period from a previous operation by vibrators 30 or restoring unit.

Although the recording head 20 moves in the moving direction and the recording medium 10 is conveyed in the conveying direction orthogonal to the moving direction in image formation, the present invention is not limited thereto. The recording head 20 may be formed over the recording medium 10 and form an image on the recoding medium 10 without moving. In this case, the vibrators 30 are driven by the drive unit 30 when the recording medium 10 is not positioned above the vibrators 30.

The vibrators 30 may be disposed only a specific position where the operation for preventing ink from increasing in viscosity or drying is performed. In this case, the recording head 20 moves to the position and the vibrators 30 are driven by the drive circuit 31. The vibrators 30 maybe arranged within a range smaller than the length L of the entire range of the nozzles 21 in the moving direction X. In this case, the recording head 20 may be moved so that the respective nozzles 21 face the vibrators 30 in order. The recording head 20 may stop for a predetermined time period at position where nozzles for each line (color) face the vibrators 30. The time period for each color may be different in each color. According to this configuration, the vibration can be adjusted on a color by color basis.

The vibrators may be a speaker. Any vibrators, which may vibrate air between the vibrators 30 and the nozzles 21, can be used as the vibrators 30.

The present invention provides illustrative, non-limiting embodiments as follows:

An image forming apparatus comprises: a recording head including a plurality of nozzles which ejects ink drops onto a recording medium to form an image; and a vibrator which is disposed to face the plurality of nozzles and vibrates in a non-printing state. The non-printing state includes a state where the image forming apparatus is in a standby state and a state where the nozzles do not face the recording medium and do not eject ink drop during printing time.

The recording head may move along the recording medium in a moving direction.

The vibrator may be located at a position outside a conveying path within which the recording medium is conveyed, and faces the plurality of nozzles in parallel therewith.

The vibrator may include a plurality of vibrators arranged in the moving direction of the recording head. The image forming apparatus may further comprise a drive circuit which drives the plurality of vibrators to vibrate selectively according to a width of the recording medium.

The vibrator may be disposed outside a maximum conveying path within which a maximum recording medium usable in the image forming apparatus is conveyed.

The vibrator may include a plurality of vibrators arranged in a range including the maximum conveying path.

The image forming apparatus may further comprise a setting unit which sets a width of the recording medium. The drive circuit may drive vibrators located outside the recording medium and proximal to the recording head when the recording head moves outside the width of the recording medium set by the setting unit.

The image forming apparatus may further comprise a detector which detects a width of the recording medium. The drive circuit may drive vibrators located outside the recording medium and proximal to the recording head when the recording head moves outside the width of the recording medium detected by the detector.

The vibrator may vibrate to generate acoustic vibration to ink in the plurality of nozzles.

The vibrator may be disposed away from the recording head when the vibrator vibrates.

The vibrator may be arranged in a range larger than a range of the nozzles. The drive circuit may drive the vibrator to vibrate when the vibrator faces an entire range of the nozzles.

The nozzles may be arranged in a line extending in a direction orthogonal to the moving direction. The vibrator maybe disposed in a range corresponding to a range of the nozzles in the direction orthogonal to the moving direction.

The nozzles may be arranged in a plurality of lines extending in the direction orthogonal to the moving direction. The drive circuit may drive the vibrator to vibrate when the nozzles in at least one of the plurality of lines face the vibrator.

The drive circuit may drive the vibrator to vibrate at least once in a first time period.

The image forming apparatus may further comprise a restoring unit which restores function of the recording head at least once in a second time period longer than the first time period.

The vibrator may include a speaker.

An image forming apparatus comprises: a recording head including a plurality of nozzles which eject ink drops onto a recording medium to form an image; and a generating means for generating acoustic vibration in inks in the plurality of nozzles to agitate the inks.

According to the above configuration, a plurality of nozzles the recording head and vibrators are opposed to each other in parallel to each other as the reading head moves to a position outside a recording medium. Acoustic vibrations are given to ink in the plurality of nozzles by driving the vibrators. Therefore, inks in the nozzles are agitated, and inks are prevented from increasing in viscosity and drying.

According to the above configuration, vibrators located outside the recording medium, of the plurality of vibrators are selectively driven according to the width of the recording medium. Therefore, inks in the nozzles are agitated by acoustic vibrations, and inks are prevented from increasing in viscosity and drying, effectively.

According to the above configuration, inks in the nozzles are agitated by acoustic vibrations at both the outsides of the recording medium, and inks are prevented from increasing in viscosity and drying.

According to the above configuration, inks in the nozzles are agitated by acoustic vibrations at both the outsides of the recording medium of various types of widths, and inks are prevented from increasing in viscosity and drying.

According to the above configuration, when the recording head moves to a position outside the recording medium if the width of a recording medium is set by a setting unit, a vibrator that is located outside the corresponding recording medium and in proximity of the recording medium is driven. Therefore, inks in the nozzles are agitated at a position proximal to the recording medium, and inks are prevented from increasing in viscosity and drying.

According to the above configuration, when the recording head moves to a position outside the recording medium if the width of the recording medium is detected by a detector, a vibrator that is located outside the corresponding recording medium and in proximity of the recording medium is driven. Therefore, inks in the nozzles are agitated at a position proximal to the recording medium, and inks are prevented from increasing in viscosity and drying.

While the present invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus comprising:

a recording head including a plurality of nozzles which eject ink drops onto a recording medium to form an image; and a vibrator which is disposed to face the plurality of nozzles and vibrates in a non-printing state;

wherein the recording head moves along the recording medium moving direction;

wherein the vibrator includes a plurality of vibrators arranged in the moving direction of the recording head; and wherein the image forming apparatus further comprises drive circuit which drives the plurality of vibrators to vibrate selectively according to a width of the recording medium.

2. The image forming apparatus according to claim 1;

wherein the vibrator is located at a position outside a conveying path within which the recording medium is conveyed, and faces the plurality of nozzles in parallel therewith.

3. The image forming apparatus according to claim 1;

wherein the vibrator is disposed outside a maximum conveying path within which a maximum recording medium usable in the image forming apparatus is conveyed.

4. The image forming apparatus according to claim 3;

wherein the vibrator includes a plurality of vibrators arranged in a range including the maximum conveying path.

5. The image forming apparatus according to claim 1, further comprising;

a setting unit which sets a width of the recording medium;

wherein the drive circuit drives vibrators located outside the recording medium and proximal to the recording head when the recording head moves outside the width of the recording medium set by the setting unit.

6. The image forming apparatus according to claim 1, further comprising;

a detector which detects a width of the recording medium;

wherein the drive circuit drives vibrators located outside the recording medium and proximal to the recording head when the recording head moves outside the width of the recording medium detected by the detector.

7. The image forming apparatus according to claim 1;

wherein the vibrator vibrates to generate acoustic vibration to ink in the plurality of nozzles.

8. The image forming apparatus according to claim 1;

wherein the vibrator is disposed away from the recording head when the vibrator vibrates.

9. The image forming apparatus according to claim 1;

wherein the vibrator is arranged in a range larger than a range of the nozzles; and wherein the image forming apparatus further comprises a drive circuit which drives the vibrator to vibrate when the vibrator faces an entire range of the nozzles.

10. The image forming apparatus according to claim 1;

wherein the nozzles are arrange in a line extending in a direction orthogonal to the moving direction; and wherein the vibrator is disposed in a range corresponding to a range of the nozzles in the direction orthogonal to the moving direction.

11. The image forming apparatus according to claim 10;

wherein the nozzles are arranged in a plurality of lines extending in the direction orthogonal to the moving direction; and wherein the image forming apparatus further comprises a drive circuit which drives the vibrator to vibrate when the nozzles in at least one of the plurality of lines face the vibrator.

12. The image forming apparatus according to claim 1, further comprising:

a drive circuit which drives the vibrator to vibrate at least once in a first time period.

13. The image forming apparatus according to claim 12, further comprising;

a restoring unit which restores function of the recording head at least once in a second time period longer than the first time period.

14. The image forming apparatus according to claim 1;

wherein the vibrator includes a speaker.

15. An image forming apparatus comprising:

a recording head including a plurality of nozzles which eject ink drops onto a recording medium to form an image; and a vibrator which is disposed to face the plurality of nozzles and vibrates in a non-printing state;

wherein the recording head moves along the recording medium in a moving direction;

wherein the vibrator is disposed outside a maximum conveying path within which a maximum recording medium usable in the image forming apparatus is conveyed; and wherein the vibrator includes a plurality of vibrators arranged in a range including the maximum conveying path.

* * * * *